US008606137B2

(12) United States Patent
Maeda et al.

(10) Patent No.: US 8,606,137 B2
(45) Date of Patent: Dec. 10, 2013

(54) IMAGE FORMING APPARATUS WITH A TRANSPORTING CONTROLLER

(75) Inventors: Shouichi Maeda, Kanagawa (JP); Yoshinori Koike, Kanagawa (JP); Junichi Asaoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 163 days.

(21) Appl. No.: 13/153,003

(22) Filed: Jun. 3, 2011

(65) Prior Publication Data

US 2012/0114357 A1 May 10, 2012

(30) Foreign Application Priority Data

Nov. 9, 2010 (JP) ..... 2010-250731

(51) Int. Cl.
*G03G 15/20* (2006.01)

(52) U.S. Cl.
USPC ..... 399/68

(58) Field of Classification Search
USPC ..... 399/68, 322, 323, 405, 406
See application file for complete search history.

(56) References Cited

U.S. PATENT DOCUMENTS 6,338,481 B1 * 1/2002 Maruchi ..... 271/188
2006/0051116 A1 * 3/2006 Koshida ..... 399/68

FOREIGN PATENT DOCUMENTS

JP 2009-128441 A 6/2009
JP 2010-054819 A 3/2010

* cited by examiner

*Primary Examiner* — Billy J Lactaoen
(74) *Attorney, Agent, or Firm* — Sughrue Mion, PLLC

(57) ABSTRACT

An image forming apparatus includes an image forming unit that forms an image on a recording medium; a fixing device that nips the recording medium and that rotates at a first peripheral velocity, to transport the recording medium, and to fix the image to the recording medium; a transport path; a first transporting section that rotates at a second peripheral velocity, and nips and transports the recording medium to which the image is fixed; a second transporting section that rotates at a third peripheral velocity, and nips and transports the recording medium to which the image is fixed; a detecting unit that detects a move-out timing; and a controller that controls a peripheral velocity of the second transporting section so as to be greater than the third peripheral velocity and less than the second peripheral velocity in accordance with the timing detected by the detecting unit.

6 Claims, 8 Drawing Sheets

IMAGE FORMING APPARATUS WITH A TRANSPORTING CONTROLLER

CROSS-REFERENCE TO RELATED APPLICATIONS

This application is based on and claims priority under 35 USC 119 from Japanese Patent Application No. 2010-250731 filed Nov. 9, 2010.

BACKGROUND

Technical Field

The present invention relates to an image forming apparatus.

SUMMARY

According to an aspect of the invention, there is provided an image forming apparatus including an image forming unit that forms an image on a recording medium; a fixing device that nips the recording medium on which the image is formed at the image forming unit and that rotates at a first peripheral velocity, to transport the recording medium on which the image is formed at the image forming unit, and to fix the image to the recording medium; a transport path having a curved portion where the recording medium is curved, the transport path being provided downstream from the fixing device in a direction of transportation of the recording medium; a first transporting section provided upstream from the curved portion of the transport path, the first transporting section rotating at a second peripheral velocity that is greater than the first peripheral velocity, the first transporting section nipping and transporting the recording medium to which the image is fixed by the fixing device; a second transporting section provided downstream from the curved portion of the transport path, the second transporting section rotating at a third peripheral velocity that is less than the first peripheral velocity, the second transporting unit nipping and transporting the recording medium to which the image is fixed by the fixing device; a detecting unit that detects a move-out timing at which an upstream side end portion of the recording medium moves out of the fixing device; and a controller that controls a peripheral velocity of the second transporting section so as to be greater than the third peripheral velocity and less than the second peripheral velocity in accordance with the timing detected by the detecting unit.

BRIEF DESCRIPTION OF THE DRAWINGS

An exemplary embodiment(s) of the present invention will be described in detail based on the following figures, wherein.

DETAILED DESCRIPTION

An image forming apparatus according to an exemplary embodiment of the present invention will be described.

Figure 1:
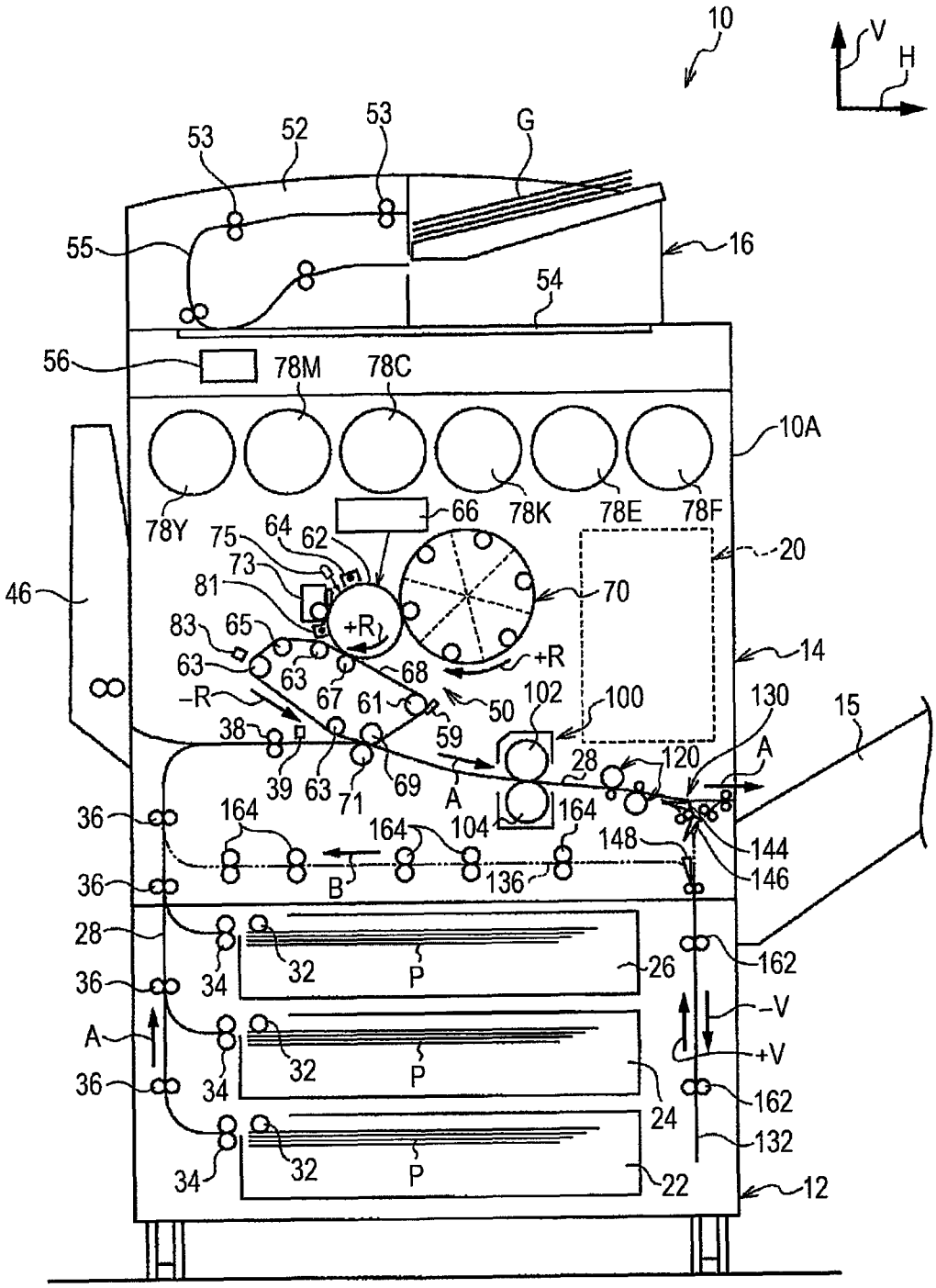
FIG. 1 shows the entire structure of an image forming apparatus according to an exemplary embodiment of the present invention.

FIG. 1 shows an image forming apparatus 10. The image forming apparatus 10 includes a sheet holding unit 12, a body 14, an original reading unit 16, and a controller 20, from a lower side to an upper side in a vertical direction (that is, in the direction of arrow V). The sheet holding unit 12 holds sheets of recording paper P serving as exemplary recording media. The body 14 is provided above the sheet holding unit 12, and performs image formation on the sheets of recording paper P supplied from the sheet holding unit 12. The original reading unit 16 is provided above the body, and reads reading originals G. The controller 20 is provided in the body 14, and serves as an exemplary controller that controls the operation of each portion of the image forming apparatus 10. In the description below, the vertical direction of an apparatus body 10A of the image forming apparatus 10 corresponds to the direction V, and the horizontal direction thereof corresponds to a direction H.

The sheet holding unit 12 includes a first holding section 22, a second holding section 24, and a third holding section 26, which hold sheets of recording paper P of different sizes. The first holding section 22, the second holding section 24, and the third holding section 26 are each provided with a sending roller 32 that sends the held sheets of recording paper P to a transport path 28 provided in the image forming apparatus 10. Pairs of transporting rollers 34 and pairs of transporting rollers 36 that transport the sheets of recording paper P one at a time are disposed downstream from the respective sending rollers 32 in the transport path 28. Adjustment rollers 38 are provided downstream from the transporting rollers 36 in a direction of transportation of the sheets of recording paper P in the transport path 28. The adjustment rollers 38 stop the sheets of recording paper P once, and send them to a second transfer position QB (described later; see FIG. 2) at a determined timing.

An upstream side portion of the transport path 28 is provided linearly from a lower left portion of the sheet holding unit 12 to a lower left portion of the body 14 in the direction V in front view of the image forming apparatus 10. A downstream side portion of the transport path 28 is provided from the lower left portion of the body 14 to a discharge unit 15 provided at the right surface of the body 14. A two-side transport path 136 is connected to the transport path 28, and allows the sheets of recording paper P to be transported and reversed for forming images on both surfaces of the sheets of recording paper P. A folding-type manual sheet feeding unit 46 is provided at the left surface of the body 14. A transport path of the sheets of recording paper P that are sent from the manual sheet feeding unit 46 is connected to a near side of the adjustment rollers 38 in the transport path 28. The switching between transport paths of the sheets of recording paper P will be described in detail below.

The original reading unit 16 includes a document transport device 52, a platen glass 54, and a document reading device 56. The document transport device 52 automatically transports the reading originals G one at a time. The platen glass 54 is disposed at the lower side of the document transport device 52. One reading original G is placed upon the platen glass 54. The document reading device 56 reads the reading original G transported by the document transport device 52 or the reading original G placed on the platen glass 54.

The document transport device 52 includes an automatic transport path 55 in which pairs of transporting rollers 53 are disposed. A portion of the automatic transport path 55 is disposed so that the reading original G passes the upper side of the platen glass 54. The document reading device 56 reads the reading original G transported by the document transport device 52 while it is stationary at a left end of the platen glass 54, or reads the reading original G placed on the platen glass 54 while it moves in the direction H.

The body 14 includes an image forming unit 50 serving as an exemplary image forming unit that forms a toner image (developer image) on the recording paper P. The image forming unit 50 includes a photoconductor member 62, a charging member 64, an exposure device 66, a developing device 70, an intermediate transfer belt 68, and a cleaning device 73 (described later).

The cylindrical photoconductor member 62, serving as an image carrying member, is provided at a central portion of the apparatus body 10A in the body 14. The photoconductor member 62 is rotated in a direction of arrow +R (clockwise in FIG. 2) by a driving unit (not shown), and carries at its outer peripheral surface an electrostatic latent image formed by light irradiation. The corotron charging member 64 that charges the surface of the photoconductor member 62 is provided above the photoconductor member 62 and opposes the outer peripheral surface of the photoconductor member 62.

The exposure device 66 is provided downstream from the charging member 64 in the direction of rotation of the photoconductor member 62, and opposes the outer peripheral surface of the photoconductor member 62. The exposure device 66 includes a semiconductor laser, a f-θ lens, a polygon mirror, an imaging lens, and mirrors (none of which are shown). On the basis of an image signal, laser light emitted from the semiconductor laser is deflected by the polygon mirror for performing scanning, and illuminates (is used for exposing) the outer peripheral surface of the photoconductor member 62 that is charged by the charging member 64, to form an electrostatic latent image. The exposure device 66 is not limited to a type in which the laser light is deflected by the polygon mirror for performing scanning. The exposure device 66 may be a type using a light emitting diode (LED).

The developing device 70 is provided downstream from a member that is irradiated with the exposure light of the exposure device 66 in the direction of rotation of the photoconductor member 62. The developing device 70 is a rotational switching type that develops the electrostatic latent image (formed on the outer peripheral surface of the photoconductor member 62) with toner of a determined color, to make visible the electrostatic latent image. Toner cartridges 78Y, 78M, 78C, 78K, 78E, and 78F are replaceably provided side by side in the direction H below the document reading device 56 and above the developing device 70. The toner cartridges 78Y, 78M, 78C, 78K, 78E, and 78F contain yellow (Y) toner, magenta (M) toner, cyan (C) toner, black (K) toner, a first special color (E) toner, and a second special color (F) toner, respectively. The first special color E and the second special color F are selected or are not selected from special colors (including transparent colors) which are not yellow, magenta, cyan, or black.

Figure 2:
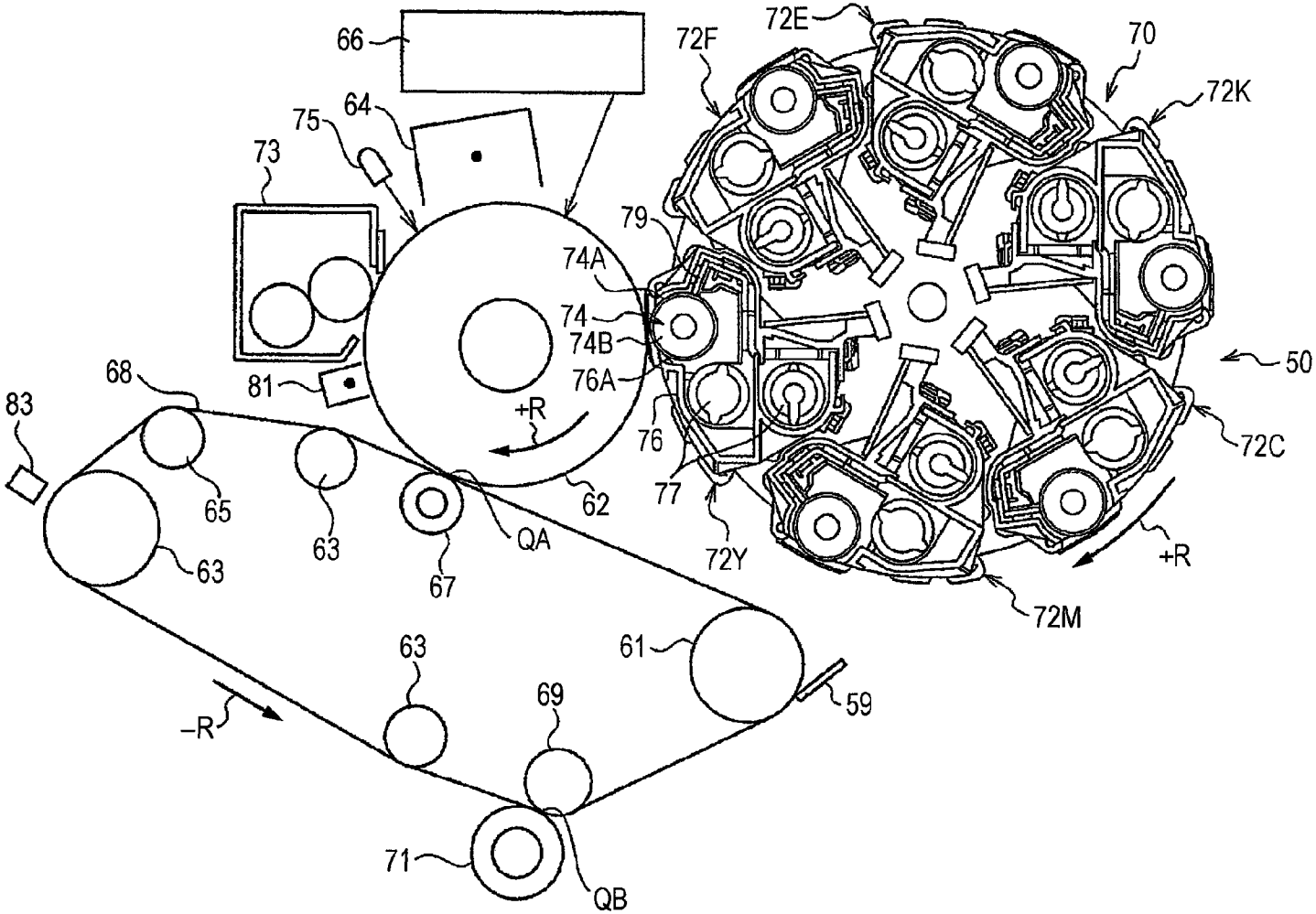
FIG. 2 shows the structure of an image forming unit according to the exemplary embodiment of the present invention.

As shown in FIG. 2, in the developing device 70, developing units 72Y, 72M, 72C, 72K, 72E, and 72F are disposed side by side in that order in a peripheral direction (that is, counterclockwise in FIG. 2) in correspondence with the toner colors, yellow (Y), magenta (M), cyan (C), black (K), the first special color (E), and the second special color (F). By rotating the developing device 70 by a motor (not shown) by a central angle of 60 degrees at a time, the developing unit 72Y, 72M, 72C, 72K, 72E, or 72F that performs a developing operation is switched, and the developing unit to perform a developing operation opposes the outer peripheral surface of the photoconductor member 62.

Since the developing units 72Y, 72M, 72C, 72K, 72E, and 72F have the same structures, here, the developing unit 72Y will be described, and the other developing units 72M, 72C, 72K, 72E, and 72F will not be described. When image formation using four colors, Y, M, C, and K, is performed, the developing units 72E and 72F are not used. Therefore, the angle of rotation from the developing unit 72K to the developing unit 72Y is 180 degrees.

The developing unit 72Y includes a case member 76 serving as a body. The case member 76 is filled with developer, formed of a carrier and toner, supplied from the toner cartridge 78Y (see FIG. 1) through a toner supply path (not shown). The case member 76 has a rectangular opening 76A opposing the outer peripheral surface of the photoconductor member 62. A development roller 74 whose outer peripheral surface opposes the outer peripheral surface of the photoconductor member 62 is provided in the opening 76A. Further, a plate-like regulating member 79 for regulating a layer thickness of the developer is provided near the opening 76A in the case member 76 so as to extend in a longitudinal direction of the opening 76A.

The development roller 74 has a rotatably provided cylindrical development sleeve 74A and a magnetic member 74B including magnetic poles fixed to the inner side of the development sleeve 74A. By rotating the development sleeve 74A, a magnetic brush of the developer (carrier) is formed. By regulating the layer thickness by the regulating member 79, a developer layer is formed on the outer peripheral surface of the development sleeve 74A. Then, the developer layer on the outer peripheral surface of the development sleeve 74A is transported to a position opposing the photoconductor member 62 by rotating the development sleeve 74A, so that toner that is in accordance with the latent image (electrostatic latent image) formed on the outer peripheral surface of the photoconductor member 62 is adhered to the latent image, to develop the latent image.

In the case member 76, two spiral transporting rollers 77 are rotatably disposed beside each other. By rotating the two transporting rollers 77, the developer with which the case member 76 is filled is circulated and transported in an axial direction of the development roller 74 (that is, in a longitudinal direction of the developing unit 72Y). The six development rollers 74 of the developing units 72Y, 72M, 72C, 72K, 72E, and 72F are disposed in the peripheral direction with the size of the interval between adjacent development rollers 74 being equal to a central angle of 60 degrees. By switching a certain developing unit 72, the next developing roller 74 is made to oppose the outer peripheral surface of the photoconductor member 62.

As shown in FIG. 1, the intermediate transfer belt 68 is provided downstream from the developing device 70 in the direction of rotation of the photoconductor member 62, and is provided below the photoconductor member 62. Toner images that are formed on the outer peripheral surface of the photoconductor member 62 are transferred to the intermediate transfer belt 68. The intermediate transfer belt 68 is an endless belt, and is placed around a driving roller 61, a tension applying roller 65, transporting rollers 63, and an auxiliary roller 69. The driving roller 61 is rotationally driven by the controller 20. The tension applying roller 65 applies tension to the intermediate transfer belt 68. The transporting rollers 63 contact the inner side of the intermediate transfer belt 68, and are driven and rotated. The auxiliary roller 69 contacts the inner side of the intermediate transfer belt 68 at the second transfer position QB (described later; see FIG. 2), and is driven and rotated. By rotating the driving roller 61, the intermediate transfer belt 68 rotates in the direction of arrow −R (that is, counterclockwise in FIG. 2).

A first transfer roller 67 is provided opposite to the photoconductor member 62 with the intermediate transfer belt 68 being interposed therebetween. The first transfer roller 67 causes the toner images formed on the outer peripheral surface of the photoconductor member 62 to be transferred to the intermediate transfer belt 68 by a first transfer operation. The first transfer roller 67 is in contact with the inner side of the intermediate transfer belt 68 at a position where the photoconductor member 62 and the intermediate transfer belt 68 contact each other (this position is called "first transfer position QA" (see FIG. 2)). By applying electric power from a power source (not shown), the first transfer roller 67 causes the toner images carried by the outer peripheral surface of the photoconductor member 62 to be transferred to the intermediate transfer belt 68 by the first transfer operation due to a potential difference between the photoconductor member 62 that is connected to ground and the first transfer roller 67.

A second transfer roller 71 is provided opposite to the auxiliary roller 69 with the intermediate transfer belt 68 being disposed therebetween. The second transfer roller 71 causes the toner images transferred to the intermediate transfer belt 68 by the first transfer operation to be transferred to recording paper P by a second transfer operation. The position between the second transfer roller 71 and the auxiliary roller 69 corresponds to the second transfer position QB where the toner images are transferred to the recording paper P (see FIG. 2). The second transfer roller 71 is connected to ground, and is in contact with the surface (outer peripheral surface) of the intermediate transfer belt 68. By a potential difference between the second transfer roller 71 and the auxiliary roller 69 to which electric power is applied from a power source (not shown), the toner images on the intermediate transfer belt 68 are transferred to the recording paper P by the second transfer operation.

A cleaning blade 59 that collects residual toner after the second transfer operation at the intermediate transfer belt 68 is provided at a side opposite to the driving roller 61 with the intermediate transfer belt 68 being disposed therebetween. The cleaning blade 59 is mounted to a housing (not shown) having an opening. Any toner that is scraped off by an end of the cleaning blade 59 is collected in the housing.

A position detecting sensor 83 is provided at a position opposing the transporting roller 63 near the intermediate transfer belt 68. The position detecting sensor 83 detects a predetermined reference position on the intermediate transfer belt 68 by detecting a mark (not shown) on the outer surface of the intermediate transfer belt 68, and outputs a position detection signal serving as a reference of timing for starting the image formation. The position detecting sensor 83 detects a movement position of the intermediate transfer belt 68 by irradiating the intermediate transfer belt 68 with light and receiving the light reflected from the surface of the mark.

The cleaning device 73 is provided downstream from the first transfer roller 67 in the direction of rotation of the photoconductor member 62. The cleaning device 73 cleans off, for example, any residual toner that is not transferred by the first transfer operation to the intermediate transfer belt 68 and that remains on the surface of the photoconductor member 62. The cleaning device 73 collects, for example, any residual toner by a cleaning blade and a brush roller that are in contact with the outer peripheral surface of the photoconductor member 62.

A corotron 81 is provided upstream from the cleaning device 73 (that is, downstream from the first transfer roller 67) in the direction of rotation of the photoconductor member 62. The corotron 81 removes electricity of the residual toner remaining after the first transfer operation on the outer peripheral surface of the photoconductor member 62. An electricity removing device 75 that removes electricity by irradiating the outer peripheral surface of the cleaned photoconductor member 62 with light is provided downstream from the cleaning device 73 (upstream from the charging member 64) in the direction of rotation of the photoconductor member 62.

The second transfer position QB of the toner images defined by the second transfer roller 71 (see FIG. 2) is set in the transport path 28. A first sheet sensor 39 is provided between the second transfer position QB and the adjustment rollers 38 so as to be situated above the transport path 28 and near the adjustment rollers 38. The first sheet sensor 39 serves as a detecting unit that detects a front end position (that is, a downstream side end portion in the transportation direction) and a rear end position (that is, an upstream side end portion in the transportation direction) of recording paper P. For the first sheet sensor 39, for example, a reflecting optical sensor that irradiates the recording paper P with light and that receives the light reflected from the recording paper P may be used. A fixing device 100 is provided downstream from the second transfer roller 71 in the direction of transportation of the recording paper P (that is, in the direction of arrow A in FIG. 1) at the transport path 28. The fixing device 100 is an exemplary fixing device that fixes the toner images to the recording paper P to which the toner images are transferred by the second transfer roller 71.

Figure 3:
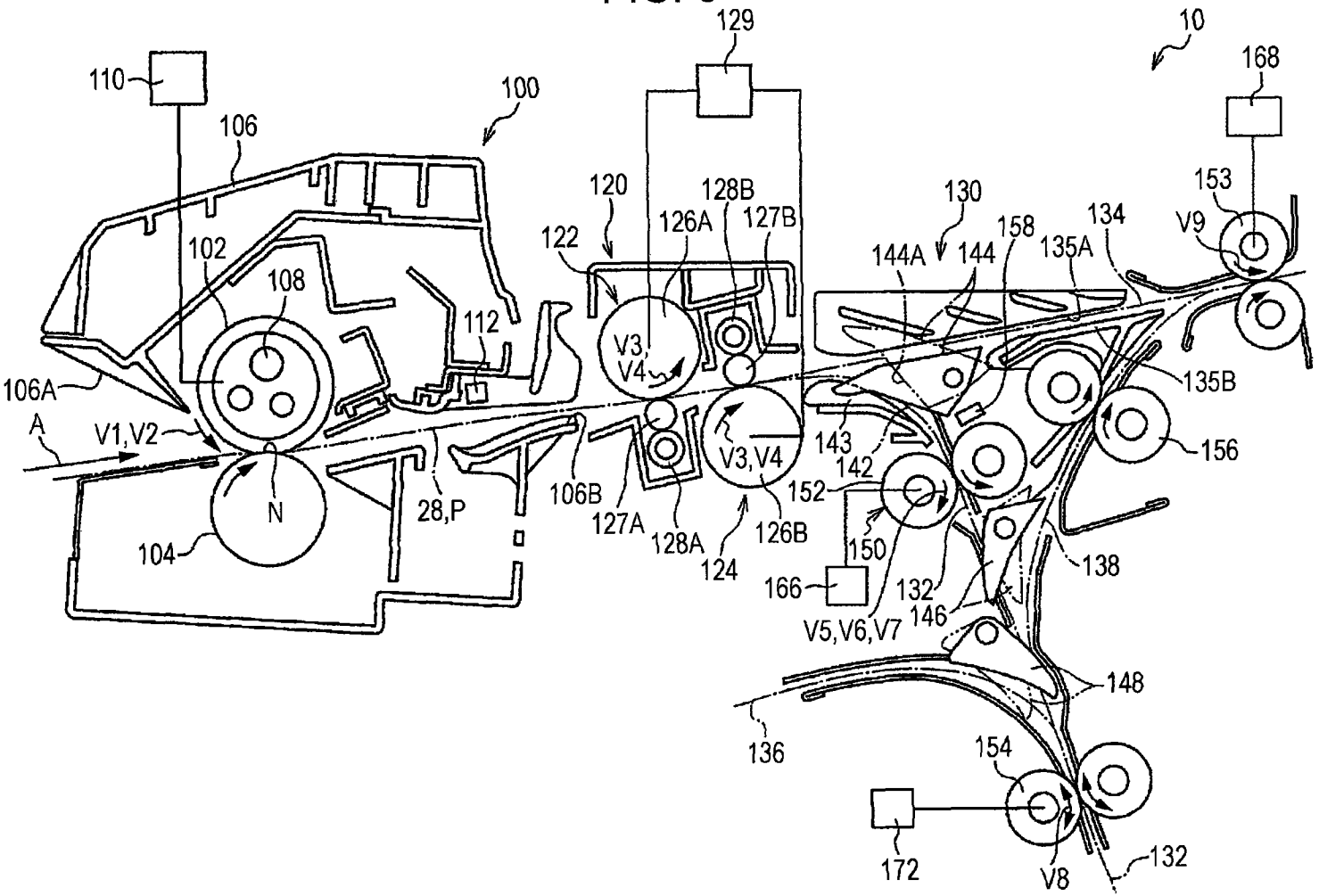
FIG. 3 shows the structure of a recording-paper transport path extending from a fixing device to a switching unit according to the exemplary embodiment of the present invention.

As shown in FIG. 3, the fixing device 100 includes a housing 106 having an opening 106A and an opening 106B. The recording paper P enters the opening 106A. The recording paper P is discharged from the opening 106B. A fixing roller 102 and a pressure roller 104 are provided as principal portions in the housing 106. The fixing roller 102 serves as an exemplary first rotating member that performs fixing by heating. The pressure roller 104 presses the recording paper P towards the fixing roller 102. Although the fixing device 100 is provided with, for example, temperature sensors that detect the temperatures of the pressure roller 104, the fixing roller 102, and an external heating roller that heats the fixing roller 102, these are not illustrated.

The fixing roller 102 is disposed at a toner image side (upper side) above the transport path 28 of the recording paper P. A rotary shaft of the fixing roller 102 is disposed so as to be orthogonal to the direction of transportation of the recording paper P. In an exemplary structure of the fixing roller 102, an elastic material, such as silicon rubber, covers the outer periphery of a cylindrical core formed of aluminum (not shown). A parting layer formed of fluorocarbon resin is formed around the outer peripheral surface of the elastic material. A halogen heater 108 is provided within the core. The halogen heater 108 serves as a heat source that is not in contact with the inner peripheral surface of the core. The halogen heater 108 is heated by heat generated by application of electric power from a power source (not shown), to heat the core, so that the entire fixing roller 102 is heated.

A first motor 110 that is capable of changing the peripheral velocity of the fixing roller 102 is connected to an end of the core of the fixing roller 102 through a gear (not shown). The first motor 110 is driven on the basis of a command signal sent from the controller 20 to rotationally drive the fixing roller 102 so that the peripheral velocity of the fixing roller 102 becomes a peripheral velocity V1 during ordinary fixing, and becomes a peripheral velocity V2 (serving as an exemplary first peripheral velocity during fixing) when the velocity is reduced for increasing the heat quantity applied to the toner images on the recording paper P. In the following description, two modes will be distinguished from each other, that is, an ordinary mode when the fixing roller 102 rotates at the peripheral velocity V1 to perform fixing, and a velocity-reduction mode when the fixing roller 102 rotates at the peripheral velocity V2 to perform fixing.

The pressure roller 104 is disposed below the fixing roller 102 at the transport path of recording paper P. By a biasing force, such as that of a spring (not shown), the pressure roller 104 contacts the outer peripheral surface of the fixing roller 102 and presses the outer peripheral surface of the fixing roller 102, so that a contact area (that is, a nip part N) is formed between the fixing roller 102 and the pressure roller 104. In an exemplary structure of the pressure roller 104, an elastic material, such as silicon rubber, covers the outer periphery of a cylindrical core formed of aluminum. A parting layer formed of fluorocarbon resin is formed around the outer peripheral surface of the elastic material. The pressure roller 104 is rotated by being driven by the rotation of the fixing roller 102. A halogen heater, serving as a heat source, may be provided within the core to heat the pressure roller 104.

A second sheet sensor 112 is provided above the transport path 28 in the fixing device 100. The second sheet sensor 112 serves as another detecting unit that detects a front end position (that is, a downstream side end portion) in the transportation direction of recording paper P and a rear end position (that is, an upstream side end portion) in the transportation direction of recording paper P. For the second sheet sensor 112, for example, a reflecting optical sensor that irradiates the recording paper P with light and that receives the light reflected from the recording paper P may be used. The second sheet sensor 112 is mounted at a position that is downstream from the nip part N in the direction of transportation of the recording paper P (that is, in the direction of arrow A) and that is upstream from the opening 106B in the direction of transportation of the recording paper P.

Here, on the basis of an output of the first sheet sensor (see FIG. 1) or an output of the second sheet sensor 112 (see FIG. 3), the controller 20 is capable of predicting a timing when the rear end of recording paper P in the direction of transportation thereof moves out of the nip part N between the fixing roller 102 and the pressure roller 104 (hereunder referred to as "move-out timing T").

As a method of predicting the move-out timing T using the first sheet sensor 39, the following method may be used. For example, a passage time $\Delta t=(La/Va)+(Lb/Vb)+(Lc/Vc)=ta+tb+tc$ is determined, where ta is the time obtained by dividing a distance La by a peripheral velocity Va of the adjustment rollers 38, tb is the time obtained by dividing a distance Lb by a peripheral velocity Vb of the second transfer roller 71, and tc is the time obtained by dividing an entire length Lc of recording paper P in the direction of transportation thereof by a peripheral velocity Vc of the fixing roller 102. The distance La is the distance from a position of detection of the first sheet sensor 39 at the transport path 28 to the second transfer position QB (see FIG. 2). The distance Lb is the distance from the second transfer position QB to the position of a downstream end of the nip part N between the fixing roller 102 and the pressure roller 104. The timing obtained by adding the passage time $\Delta t$ to a timing t when the front end of the recording paper P in the transportation direction thereof is detected by the first sheet sensor 39 is set as the move-out timing T of the recording paper P.

The distances La, Lb, and Lc are known. It is possible to know the peripheral velocities Va, Vb, and Vc from settings. Therefore, the move-out timing T is predicted before the recording paper P moves out of the nip part N. The distances La, Lb, and Lc, the peripheral velocities Va, Vb, and Vc, the timings ta, tb, tc, and t, the passage time $\Delta t$, and the move-out timing T are not illustrated.

As a method of predicting the move-out timing using the second sheet sensor 112, the following method may be used. For example, a transportation velocity of recording paper P at a position where the recording paper P is detected by the second sheet sensor 112 is assumed to follow the peripheral velocity Vc of the fixing roller 102. The distance from the position of the downstream end of the nip part N to the position of detection of the second sheet sensor 112 at the transport path 28 is Ld. The timing obtained by adding (Lc-Ld)/Vc to the timing t when the front end of the recording paper P in the transportation direction thereof is detected by the first sheet sensor 39 is set as the move-out timing T of the recording paper P. The distance Ld is not illustrated.

In this way, it is possible to predict the move-out timing T using each sheet sensor. Here, although, in the exemplary embodiment, the case in which the move-out timing T is predicted using the first sheet sensor 39 is given as an example, the move-out timing T may also be predicted using the second sheet sensor 112.

Next, the transport path 28 and the two-side transport path 136 will be described in detail.

As shown in FIG. 3, a decurl unit 120 is provided downstream from the fixing device 100 in the direction of transportation of recording paper P at the transport path 28. The decurl unit 120 straightens in the opposite direction a curl of the recording paper P after the fixing by the fixing device 100. The straightening of the curl of the recording paper P by the decurl unit 120 is performed regardless of switching between the transport paths of the recording paper P.

The decurl unit 120 includes a first decurl section 122 and a second decurl section 124. The first decurl section 122 serves as an exemplary first transporting section and is disposed at an upstream side in the direction of transportation of recording paper P. The second decurl section 124 serves as another exemplary first transporting section and is disposed at a downstream side in the direction of transportation of recording paper P. The first decurl section 122 includes a decurl roller 126A, a metallic roller 127A, and a bearing 128A. The decurl roller 126A is an exemplary second rotating member that is a sponge roller disposed at the upper side of the transport path 28. The metallic roller 127A is disposed at the lower side of the transport path 28 and contacts the outer peripheral surface of the decurl roller 126A. The bearing 128A contacts the outer peripheral surface of the metallic roller 127A at a side opposite to the decurl roller 126A, and reduces flexing of the metallic roller 127A. The outside diameter of the decurl roller 126A is larger than the outside diameter of the metallic roller 127A.

The second decurl section 124 includes a decurl roller 126B, a metallic roller 127B, and a bearing 128B. The decurl roller 126B is another exemplary second rotating member that is a sponge roller disposed at the lower side of the transport path 28. The metallic roller 127B is disposed at the upper side of the transport path 28 and contacts the outer peripheral surface of the decurl roller 126B. The bearing 128B contacts the outer peripheral surface of the metallic roller 127B at a side opposite to the decurl roller 126B, and reduces flexing of the metallic roller 127B. The outside diameter of the decurl roller 126B is larger than the outside diameter of the metallic roller 127B.

The decurl roller 126A and the decurl roller 126B, the metallic roller 127A and the metallic roller 127B, and the bearing 128A and the bearing 128B are formed of the same material and have the same shape. Directions of rotation axes of the decurl roller 126A, the decurl roller 126B, the metallic roller 127A, the metallic roller 127B, the bearing 128A, and the bearing 128B are orthogonal to the direction of transportation of recording paper P.

One second motor 129 is connected to end portions of the cores (not shown) of the decurl rollers 126A and 126B through gears (not shown). The second motor 129 is driven on the basis of a command signal sent from the controller 20 to rotationally drive the decurl rollers 126A and 126B so that the peripheral velocities of the decurl rollers 126A and 126B are a peripheral velocity V3 (≥V1) in the ordinary mode and are a peripheral velocity V4 (V2≤V4<V3) serving as an exemplary second peripheral velocity in the velocity-reduction mode. The decurl roller 126A rotates in the illustrated counterclockwise direction, whereas the decurl roller 126B rotates in the illustrated clockwise direction.

As shown in FIG. 3, a switching unit 130 is provided downstream from the decurl unit 120 in the direction of transportation of recording paper P. The switching unit 130 switches the direction of transportation of recording paper P transported along the transport path 28. At the switching unit 130, a terminal end of the transport path 28 is divided into a reverse transport path 132 and a first discharge path 134. The reverse transport path 132 is an exemplary transport path having a curved portion 142 that curves downward. The first discharge path 134 is approximately a straight path, and extends towards the discharge unit 15 (see FIG. 1).

A portion of the reverse transport path 132 is divided into the two-side transport path 136 and a second discharge path 138. The two-side transport path 136 extends towards the transporting rollers 36 for forming an image on the back of the recording paper P. The second discharge path 138 extends towards the discharge unit 15. A guide member 143 having a curved surface forming the curved portion 142 is provided at the reverse transport path 132. A guide member 135A and a guide member 135B are provided at the first discharge path 134. The guide member 135A forms an upper wall of the first discharge path 134. The guide member 135B forms a bottom wall of the first discharge path 134 disposed opposite to the guide member 135A. For saving space in the transport path of recording paper P, the guide members 135A and 135B are disposed with a small distance therebetween, and the transport path of recording paper P is formed straight.

As shown in FIG. 1, the reverse transport path 132 is formed straight in the direction of arrow V (downward direction is indicated by −V, and upward direction is indicated by +V) from the lower right side of the body 14 to the lower right side of the sheet holding unit 12. Pairs of transporting rollers 162 that transport recording paper P are provided at the reverse transport path 132. The two-side transport path 136 is provided from a portion of the reverse transport path 132 (a third switching member 148 (described later)) towards the transporting rollers 36 in the direction H. Pairs of transporting rollers 164 that transport recording paper P are provided at the two-side transport path 136. By switching an entrance path of the rear end of the recording paper P to the two-side transport path 136 by the third switching member 148 (described below), the recording paper P that has entered the reverse transport path 132 is transported in the two-side transport path 136 in the direction of arrow B (that is, leftwards in FIG. 1). A terminal end of the two-side transport path 136 is connected to a near side of the transporting rollers 36 at the transport path 28.

As shown in FIG. 3, the switching unit 130 includes a first switching member 144, a second switching member 146, and a third switching member 148. The first switching member 144 switches the transport path of recording paper P from the transport path 28 to the reverse transport path 132 or the first discharge path 134. The second switching member 146 switches between the reverse transport path 132 and the second discharge path 138. The third switching member 148 switches between the two-side transport path 136 and the second discharge path 138. The first switching member 144, the second switching member 146, and the third switching member 148 are all triangular prismatic members. When an end of a particular switching member is moved into one particular transport path by a driving unit (not shown), the transport path of recording paper P is switched to another transport path.

A reverse transporting section 150 serving as an exemplary second transporting section that transports recording paper P is provided between the first switching member 144 and the second switching member 146. The reverse transporting section 150 includes a pair of first transporting rollers 152 and a third motor 166. The pair of first transporting rollers 152 are exemplary third rotating members. The third motor 166 has its rotation controlled (changed) by the controller 20 (see FIG. 1), and rotationally drives the first transporting rollers 152.

The third motor 166 rotates the first transporting rollers 152 at a peripheral velocity V5 in the ordinary mode, rotates the first transporting rollers 152 at a peripheral velocity V6 (<V5) serving as an exemplary third peripheral velocity in the velocity-reduction mode, and rotates the first transporting rollers 152 at a peripheral velocity V7 when the transporting velocity of recording paper P (described later) is increased from the state in which the third motor 166 rotates the first transporting rollers 152 at the peripheral velocity V6. The peripheral velocity V7 is determined on the basis of the peripheral velocity V4 of the decurl rollers 126A and 126B.

A pair of second transporting rollers 154 that transport recording paper P are provided downstream from (at the lower side of) the third switching member 148. A pair of third transporting rollers 156 that transport recording paper P are provided at the second discharge path 138. A pair of discharge rollers 153 that discharge the recording paper P to the discharge unit 15 (see FIG. 1) are provided at a terminal end of the first discharge path 134.

By a fourth motor 168 whose operation or stoppage is controlled by the controller 20, the discharge rollers 153 rotate at a peripheral velocity V9, and are not reduced in velocity. A lower limit of the peripheral velocity V9 is larger than an upper limit of the peripheral velocity V3 of the decurl rollers 126A and 126B (the peripheral velocity V1 of the fixing roller 102). For example, V9=1.5×V3. The second transporting rollers 154 are rotated at a peripheral velocity V8 by a fifth motor 172 whose rotation is controlled by the controller 20. Although the third transporting rollers 156 are driven by a motor (not shown), the driving will not be described.

A third sheet sensor 158 is provided between the first switching member 144 and the pair of first transporting rollers 152 outside the reverse transport path 132. The third sheet sensor 158 detects a front end position and a rear end position of recording paper P that is transported in the reverse transport path 132. For the third sheet sensor 158, for example, a reflecting optical sensor that irradiates the recording paper P with light and that receives the light reflected from the recording paper P may be used.

Here, the distance from the fixing roller 102 to the first transporting rollers 152 is set smaller than the entire length of the recording paper P in the transportation direction thereof, so that a timing in which the recording paper P is nipped by both the fixing roller 102 and the first transporting rollers 152 is provided. The distance from the fixing roller 102 to the discharge rollers 153 is set smaller than the entire length of the recording paper P in the transportation direction thereof, so that a timing in which the recording paper P is nipped by both the fixing roller 102 and the discharge rollers 153 is provided.

Next, the structure of each motor will be described.

Figure 4A:
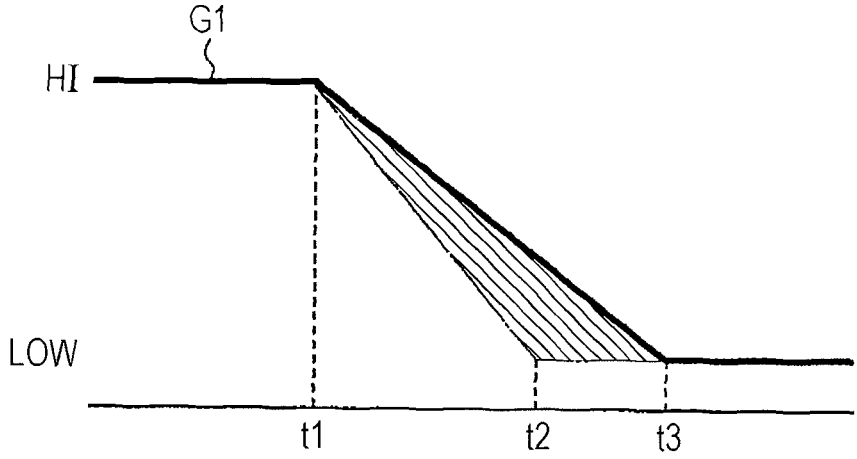
FIG. 4A is a schematic view showing velocity-reduction control of a fixing roller (DC motor) according to the exemplary embodiment of the present invention.

In FIG. 3, in the exemplary embodiment, for example, DC motors are used for the first motor 110 and the second motor 129. As shown in FIG. 4A, when each DC motor is reduced in velocity from HI to LOW at a timing t1, a timing in which the velocity becomes LOW varies from a timing t2 to a timing t3. Therefore, the velocity may be low at the timing t2 (t1<t2<t3) without becoming LOW at the timing t3 (>t1) (solid-line graph G1). That is, when the velocity of the first motor 110 and the velocity of the second motor 129 are reduced, outputs vary in a shaded range shown in FIG. 4A.

Figure 4B:
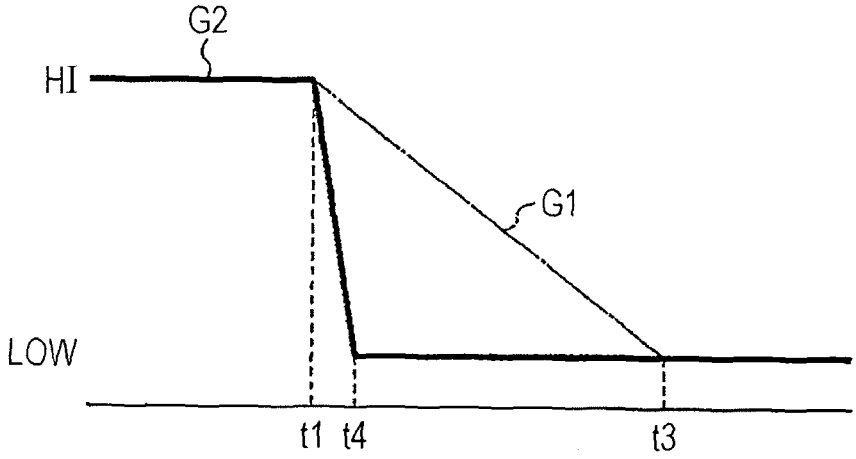
FIG. 4B is a schematic view showing velocity-reduction control of first transporting rollers (stepping motors) according to the exemplary embodiment of the present invention.

For example, stepping motors are used for the third motor 166, the fourth motor 168, and the fifth motor 172. As shown in FIG. 4B, when the velocity of each stepping motor is reduced from HI to LOW at the timing t1, each output is stable compared to that of each DC motor. Therefore, the velocity becomes LOW at a timing t4 (t1<t4<t2)(solid-line graph G2). A DC motor is used for the fixing roller 102. This is because, when a stepping motor is used, a load that is generated by pressure at the nip part N of the fixing device 100 (see FIG. 3) is large and varies considerably. Stepping motors are used for, for example, the first transporting rollers 152 and the discharge rollers 153 for ensuring stoppage precision of the recording paper P.

Next, the setting of the peripheral velocity of each roller will be described.

In the image forming apparatus 10 shown in FIG. 1, the peripheral velocity of the fixing roller 102, the peripheral velocity of the decurl roller 126A (126B), and the peripheral velocities of the first transporting rollers 152 are set to the peripheral velocities in the velocity-reduction mode that are lower than the peripheral velocities in the ordinary mode (as described below, only the peripheral velocities of the first transporting rollers 152 are set in three steps). This is due to the following reason. That is, in the fixing device 100 shown in FIG. 3, when recording paper P passes the nip part N, the heat quantity of the fixing roller 102 is taken away by the recording paper P, as a result of which the gloss of the rear end of the recording paper P is less than that of the front end of the recording paper P, that is, what is called uneven brightness occurs.

That is, in order to reduce the peripheral velocity of the fixing roller 102 from V1 to V2 (<V1), and increase the heat quantity applied to toner images to reduce uneven brightness, the velocities of the fixing roller 102 and the other rollers are reduced. Here, since the peripheral velocity of the fixing roller 102 is reduced from V1 to V2 after the rear end (upstream side end portion) of the recording paper P moves out of the second transfer position QB (see FIG. 2), the recording paper P is nipped at the nip part N between the fixing roller 102 and the pressure roller 104, a nip part at the decurl roller 126A (126B), and a nip part between the first transporting rollers 152. Whether the velocities of the rollers other than the fixing roller 102, the decurl roller 126A (126B), and the first transporting rollers 152 are reduced will not be described below.

Figure 5A:
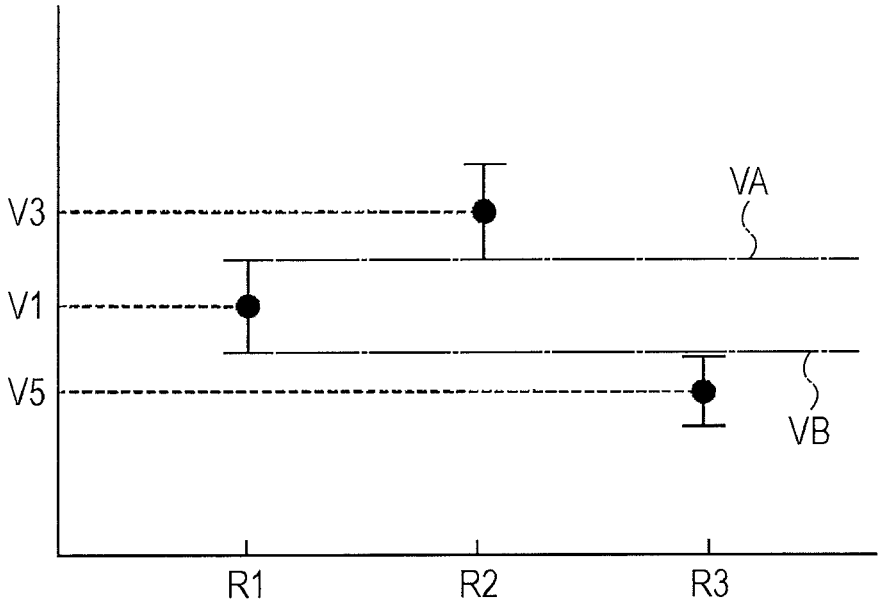
FIGS. 5A and 5B are graphs that compare peripheral velocities of the fixing roller, a decurl roller, and the first transporting rollers according to the exemplary embodiment of the present invention in an ordinary mode and those in a velocity-reduction mode.

FIG. 5A is a graph showing settings of the peripheral velocities of the fixing roller 102, the decurl roller 126A (126B), and the first transporting rollers 152 in the ordinary mode. A horizontal axis R1 of the graph corresponds to the fixing roller 102. A horizontal axis R2 of the graph corresponds to the decurl roller 126A (126B). A horizontal axis R3 of the graph corresponds to the first transporting rollers 152. A central value of the setting of each peripheral velocity is shown by a black dot, and the range of variation from each central value is shown by a solid line extending vertically from the corresponding black dot.

With the peripheral velocity V1 of the fixing roller 102 serving as a reference, a lower limit of the peripheral velocity V3 of the decurl roller 126A (126B) is equal to or slightly larger than an upper limit of the peripheral velocity V1 (shown by an alternate long and short dash line VA in FIG. 5A). An upper limit of the peripheral velocity V5 of each first transporting roller 152 is slightly less than a lower limit of the peripheral velocity V1 (shown by an alternate long and short dash line VB in FIG. 5A).

Figure 5B:
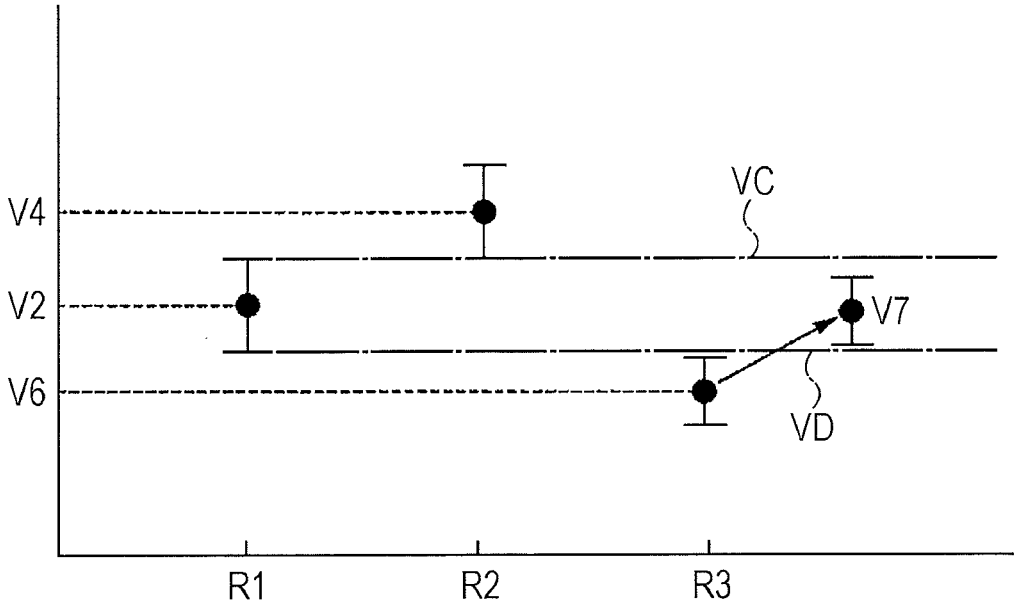

FIG. 5B is a graph showing settings of the peripheral velocities of the fixing roller 102, the decurl roller 126A (126B), and the first transporting rollers 152 in the velocity-reduction mode. In the velocity-reduction mode, the peripheral velocity of the decurl roller 126A (126B) and the peripheral velocity of the first transporting rollers 152 are set so as to be reduced by a similar proportion (ratio) while the relationship of the central value of the peripheral velocity V3 and the central value of peripheral velocity V4 with respect to the central value of the peripheral velocity V1 (see FIG. 5A) is maintained.

With the peripheral velocity V2 of the fixing roller 102 serving as a reference, a lower limit of the peripheral velocity V4 of the decurl roller 126A (126B) is equal to or slightly larger than an upper limit of the peripheral velocity V2 (shown by an alternate long and short dash line VC in FIG. 5B). An upper limit of the peripheral velocity V6 of each first transporting roller 152 is slightly less than a lower limit of the peripheral velocity V2 (shown by an alternate long and short dash line VD in FIG. 5A).

Figure 6:
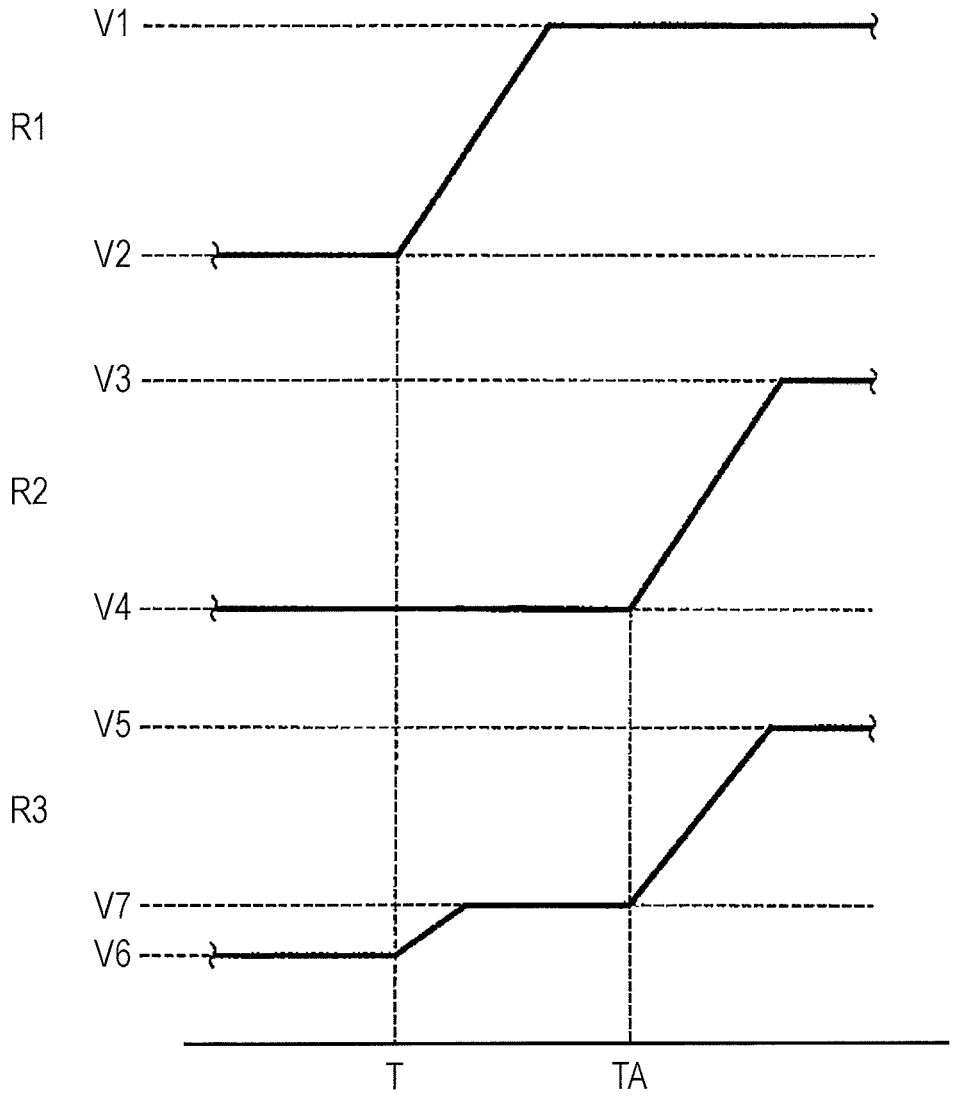
FIG. 6 is a graph that compares changes in the peripheral velocity of the fixing roller and changes in the peripheral velocity of each first transporting roller according to the exemplary embodiment of the present invention.

Here, as shown in FIG. 6, in the exemplary embodiment, at the move-out timing T in the velocity-reduction mode of the fixing roller 102 and the first transporting rollers 152 (see FIG. 3)(that is, the timing when the rear end of recording paper P in the direction of transportation thereof moves out of the nip part N between the fixing roller 102 and the pressure roller 104), the peripheral velocity of the fixing roller 102 is set so as to start increasing from V2 to V1, and the peripheral velocity of each first transporting roller 152 is set so as to start increasing from V6 to V7 (V6<V7<V5). At this time, the peripheral velocity of the decurl roller 126A (126B) is V4.

At a timing TA when the rear end (upstream side end portion) of the recording paper P moves out of the nip part at the decurl roller 126B, the peripheral velocity of the decurl roller 126A (126B) is set so as to start increasing from V4 to V3, and the peripheral velocity of each first transporting roller 152 is set so as to start increasing from V7 to V5.

As shown in FIG. 5B, an upper limit of the peripheral velocity V7 of each first transporting roller 152 is less than the upper limit of the peripheral velocity V2 of the fixing roller 102 (shown by the alternate long and short dash line VC in FIG. 5B). In addition, a lower limit of the peripheral velocity V7 of each transporting roller 152 is greater than the lower limit of the peripheral velocity V2 (shown by the alternate long and short dash line VD in FIG. 5A).

Next, principal switching operations between the transport paths of recording paper P at the switching unit 130, and the transport paths of recording paper P will be described.

In the image forming apparatus 10 shown in FIG. 3, when transfer (including image formation) and fixing of toner images to the front surface (that is, the illustrated upper surface) of recording paper P are completed, and, then, transfer (including image formation) and fixing of toner images to the back surface (that is, the illustrated lower surface) of the recording paper P are completed, the following occurs. That is, in the switching unit 130, the first switching member 144 moves to close the first discharge path 134 and to open the reverse transport path 132; and the second switching member 146 moves to close the second discharge path 138 and to open the reverse transport path 132. Further, the third switching member 148 moves to close the two-side transport path 136, and to open the reverse transport path 132. By this, after the recording paper P transported to the transport path 28 passes the decurl unit 120, it enters the reverse transport path 132.

Next, when the rear end of the recording paper P that enters the reverse transport path 132 passes the second transporting rollers 154, the third switching member 148 closes the second discharge path 138 and opens the two-side transport path 136, and the second transporting rollers 154 rotate in the reverse direction. By this, the rear end of the recording paper P is switched to the front end, the recording paper P is transported along the two-side transport path 136, and reenters the transport path 28, so that the image formation is performed on the back surface of the recording paper P.

In the image forming apparatus 10, when the image formation is performed only on the front surface of the recording paper P, and the front and back surfaces of the recording paper P are reversed to discharge the recording paper P, the following occurs. That is, the recording paper P enters the reverse transport path 132, and the rear end thereof passes the second transporting rollers 154, at which time the second switching member 146 moves to open the second discharge path 138. When the second transporting rollers 154 rotate in the reverse direction, the rear end of the recording paper P is switched to the front end, and the recording paper P is transported to the second discharge path 138 and discharged. When the image formation and fixing are performed on the front surface of the recording paper P, and the recording paper P is discharged as it is after passing the decurl unit 120, the following occurs. That is, the first switching member 144 moves to close the reverse transport path 132, and to open the first discharge path 134.

Next, differences between the operation of a comparative example and the operation of the exemplary embodiment will be described. In the exemplary embodiment and the comparative example, as shown in FIG. 7, the front end of the recording paper P is nipped by the pair of first transporting rollers 152, the rear end of the recording paper P is nipped by the fixing roller 102 and the pressure roller 104, and the peripheral velocity of the fixing roller 102 is reduced to V2, the peripheral velocity of the decurl roller 126A (126B) is reduced to V4, and the peripheral velocity of each first transporting roller 152 is reduced to V6.

First, as the comparative example, a structure in which the peripheral velocity of each first transporting roller 152 is maintained at V6 at the move-out timing T (that is, the peripheral velocity is not increased from V6 to V7) in FIG. 6 will be described.

Figure 7:
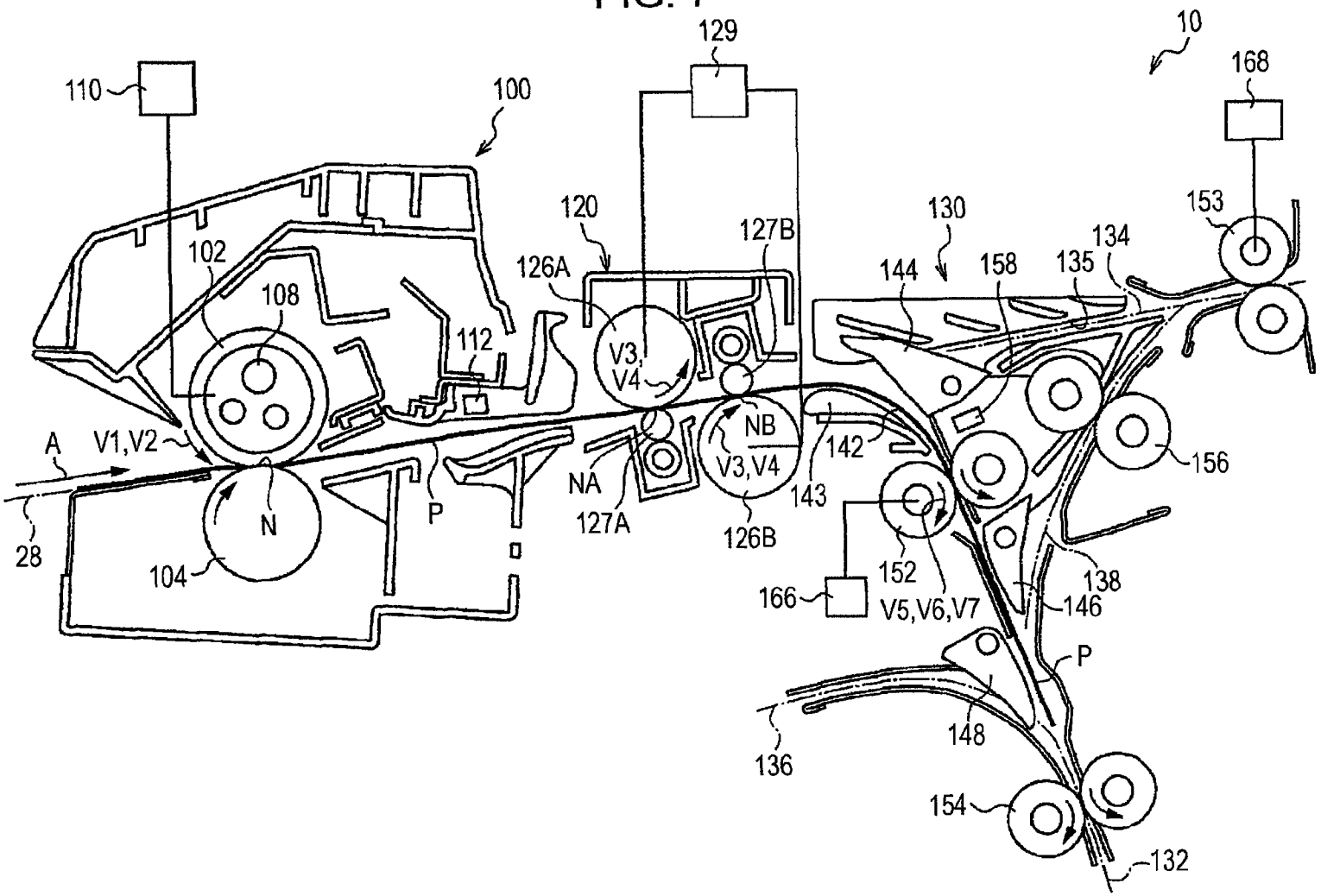
FIG. 7 illustrates a state in which recording paper is transported from the transport path to a reverse transport path according to the exemplary embodiment of the present invention.

In FIG. 7, even if the peripheral velocity V4 of the decurl roller 126A (126B) is set greater than the peripheral velocity V2 of the fixing roller 102, pressing force acting upon the recording paper P at the nip part N between the fixing roller 102 and the pressure roller 104 is greater than pressing force acting upon the recording paper P at the nip part NA (NB) at the decurl roller 126A (126B), so that transportation velocity of the recording paper P follows the peripheral velocity V2 of the fixing roller 102.

Figure 8A:
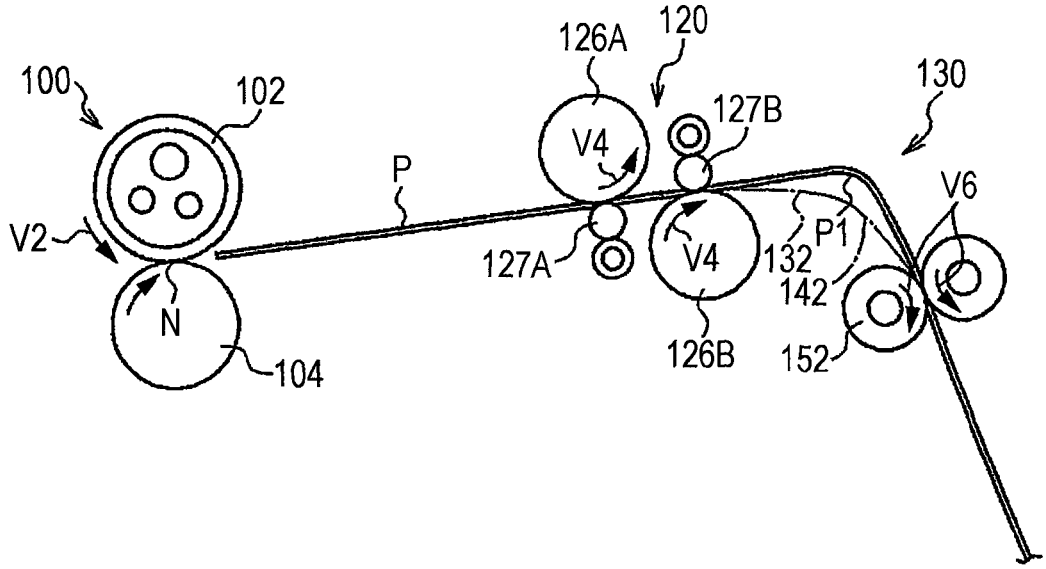
FIG. 8A is a schematic view illustrating a state in which the recording paper is flexed between the decurl roller and each first transporting roller in a comparative example.

Here, as shown in FIG. 8A, when the rear end of the recording paper P moves out of the nip part N between the fixing roller 102 and the pressure roller 104, the pressing force at the nip part N no longer acts upon the recording paper P. Therefore, the transportation velocity of the recording paper P at the nip part NA (NB) at the decurl roller 126A (126B) follows the peripheral velocity V4 of the decurl roller 126A (126B). However, since the peripheral velocity V4 of the decurl roller 126A (126B) and the peripheral velocity V6 of each first transporting roller 152 differ greatly, a flexing amount at a flexing portion P1 of the recording paper P between the decurl roller 126B and each first transporting roller 152 becomes large. That is, it becomes difficult to suppress deformation of the recording paper P, as a result of which the recording paper P contacts, for example, a wall of the transport path.

Next, the operation according to the exemplary embodiment will be described.

In the image forming apparatus 10 according to the exemplary embodiment, in FIG. 7, even if the peripheral velocity V4 of the decurl roller 126A (126B) is set higher than the peripheral velocity V2 of the fixing roller 102, the transportation velocity of the recording paper P follows the peripheral velocity V2 of the fixing roller 102. This is the same as in the comparative example.

Figure 8B:
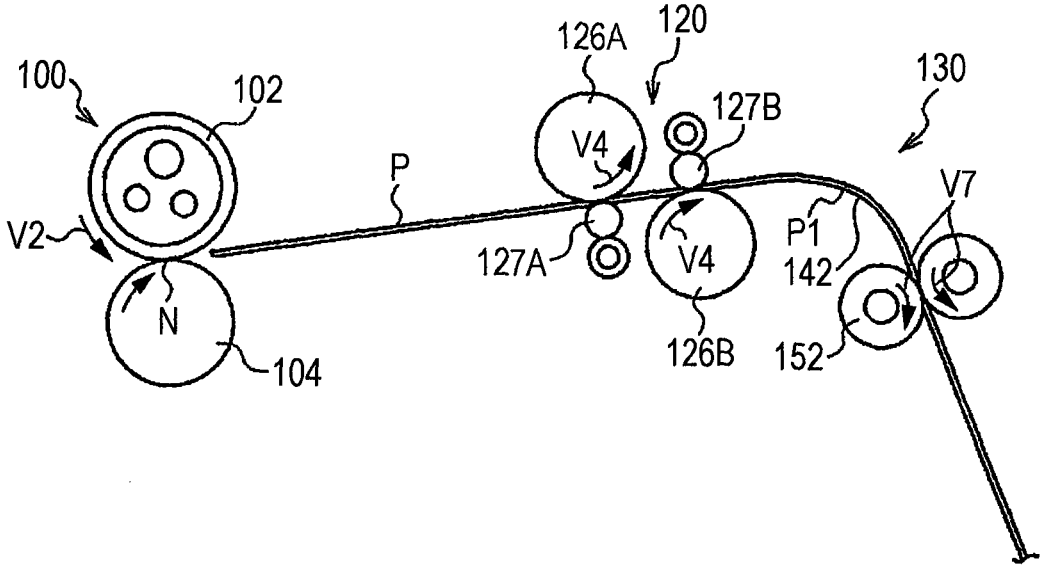
FIG. 8B is a schematic view illustrating a state in which the recording paper is flexed between the decurl roller and each first transporting roller according to the exemplary embodiment of the present invention.

As shown in FIG. 8B, when the rear end of the recording paper P moves out of the nip part N between the fixing roller 102 and the pressure roller 104 (the move-out timing T), the pressing force at the nip part N no longer acts upon the recording paper P. Therefore, the transportation velocity of the recording paper P at the nip part NA (NB) at the decurl roller 126A (126B) follows the peripheral velocity V4 of the decurl roller 126A (126B).

Here, in the exemplary embodiment, as shown in FIG. 5B and FIG. 6, since, the peripheral velocity of each transporting roller 152 is increased from V6 to V7 at the move-out timing T, the difference between the peripheral velocity V4 of the decurl roller 126A (126B) and the peripheral velocity V7 of each first transporting roller 152 is less than that in the comparative example. By this, as shown in FIG. 8B, the flexing amount at the flexing portion P1 of the recording paper P between the decurl roller 126B and each first transporting roller 152 is less than that in the comparative example. That is, the deformation of the recording paper P is suppressed.

The present invention is not limited to the above-described exemplary embodiment.

The fixing roller 102 may be a fixing belt that is heated by an electromagnetic induction method. In addition, the move-out timing T of the recording paper P may be predicted using the second sheet sensor 112, or may be predicted using a sheet sensor that is provided at another portion of the transport path 28. Further, the increasing of the peripheral velocity of each first transporting roller 152 when the rear end of the recording paper P moves out of the nip part P may be performed in the ordinary mode when the peripheral velocity of the fixing roller 102 is V1 in addition to in the velocity-reduction mode when the peripheral velocity of the fixing roller 102 is V2.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording medium;

a fixing device that nips the recording medium on which the image is formed at the image forming unit and that rotates at a first peripheral velocity, to transport the recording medium on which the image is formed at the image forming unit, and to fix the image to the recording medium;

a transport path having a curved portion where the recording medium is curved, the transport path being provided downstream from the fixing device in a direction of transportation of the recording medium;

a first transporting section provided upstream from the curved portion of the transport path, the first transporting section rotating at a second peripheral velocity that is greater than the first peripheral velocity, the first transporting section nipping and transporting the recording medium to which the image is fixed by the fixing device;

a second transporting section provided downstream from the curved portion of the transport path, the second transporting section rotating at a third peripheral velocity that is less than the first peripheral velocity, the second transporting unit nipping and transporting the recording medium to which the image is fixed by the fixing device;

a detecting unit that detects a move-out timing at which an upstream side end portion of the recording medium moves out of the fixing device; and a controller that as a result of the detecting unit detecting the move-out timing increases the third peripheral velocity of the second transporting section to a fourth peripheral velocity which is greater than the third peripheral velocity and less than the second peripheral velocity in accordance with the timing detected by the detecting unit.

2. The image forming apparatus according to claim 1, wherein the detecting unit detects the move-out timing as a result of adding a time of passage of the recording medium along the transport path to a timing when the detecting unit detects a downstream side end portion of the recording medium, the time of passage of the recording medium along the transport path being predicted on the basis of the first peripheral velocity.

3. The image forming apparatus according to claim 1, wherein the detecting unit detects the move-out timing as a result of adding a timing when the detecting unit detects a front end of the recording medium in the direction of transportation of the recording medium to a timing that is detected on the basis of a length of the recording medium in the direction of transportation of the recording medium and on the basis of a distance from a position where the fixing device nips the downstream side end portion of the recording medium to a position of detection of the detecting unit, with a transportation velocity of the recording medium at a position where the recording medium is detected being the peripheral velocity of the second transporting section.

4. The image forming apparatus according to claim 1, wherein the recording medium is simultaneously nipped at a nip part of the fixing device, a nip part of the first transporting section, and a nip part of the second transporting section before the upstream side end portion of the recording medium moves out of the fixing device.

5. The image forming apparatus according to claim 1, wherein the controller keeps a peripheral velocity of the first transporting section at the second peripheral velocity at the timing detected by the detecting unit.

6. The image forming apparatus according to claim 1, wherein the controller controls the peripheral velocity of the first transporting section so as to be greater than the second peripheral velocity and the peripheral velocity of the second transporting section so as to be greater than the fourth peripheral velocity in accordance with a timing when the upstream side end portion of the recording medium moves out of the nip part of the first transporting section.

* * * * *